United States Patent [19]

Perulfi et al.

[11] Patent Number: 4,972,055

[45] Date of Patent: Nov. 20, 1990

[54] MULTIPLE VACUUM INTERRUPTER FLUID INSULATED CIRCUIT BREAKER WITH ISOLATION GAP

[75] Inventors: John R. Perulfi, Monroeville; Joseph R. Rostron, Murrysville, both of Pa.

[73] Assignee: ABB Power T&D Company Inc., Blue Bell, Pa.

[21] Appl. No.: 458,933

[22] Filed: Dec. 29, 1989

[51] Int. Cl.[5] ..... H01H 33/66

[52] U.S. Cl. ..... 200/144 B; 200/148 B; 200/150 R; 200/145

[58] Field of Search ..... 200/144 B, 148 B, 145, 200/150 R

[56] References Cited

U.S. PATENT DOCUMENTS

| | | | |
|---|---|---|---|
| 1,720,413 | 7/1929 | Greenwood | 200/144 B |
| 1,783,279 | 12/1930 | Burnham | 200/144 B |
| 3,300,609 | 1/1967 | Flurscheim et al. | 200/144 B |
| 3,814,885 | 6/1974 | Soflanek | 200/144 B |
| 3,839,612 | 10/1974 | Badey et al. | 200/145 |
| 4,105,878 | 8/1978 | Date et al. | 200/144 B |
| 4,225,761 | 9/1980 | Barkan et al. | 200/145 |
| 4,440,995 | 4/1984 | Lange et al. | 200/144 B |
| 4,527,028 | 7/1985 | Luehring | 200/144 B |

OTHER PUBLICATIONS

Descriptive Bulletin, 33-253 D WE A, Westinghouse Electric Corporation, Oil Circuit Breaker Department, Jan. 7, 1975, pp. 1-12 (Type GM and GMA Outdoor Oil Circuit Breakers).

*Primary Examiner*—Robert S. Macon
*Attorney, Agent, or Firm*—Richard V. Westerhoff

[57] ABSTRACT

A circuit breaker utilizes a plurality of vacuum interrupters immersed in oil. A cross-bar with electrically conductive sections completes a series electrical circuit through the circuit breaker and actuates operating mechanisms, to close the contacts of the vacuum interrupters when in the raised position as the cross-bar is lowered, the contacts of the vacuum interrupters are opened by impact forces before isolation gaps which fill with oil are created in the series electrical circuit. Various arrangements of the vacuum interrupters are disclosed for uprating existing oil circuit breakers.

16 Claims, 8 Drawing Sheets

MULTIPLE VACUUM INTERRUPTER FLUID INSULATED CIRCUIT BREAKER WITH ISOLATION GAP

RELATED APPLICATION

Commonly owned, concurrently filed U.S. Pat. application Ser. No. 458,931 entitled "Fluid Insulated Vacuum Interrupter Circuit Breaker and Operating Mechanism Therefor" of Russell N. Yeckley and Robert L. Hess.

BACKGROUND OF THE INVENTION

1. Field of the Invention

This invention relates to circuit breakers for high voltage electric power transmission and distribution systems, and more particularly, to circuit breakers having multiple series connected vacuum interrupters immersed in a tank of electrically insulating fluid with an isolation gap to prevent delayed restrikes in the vacuum interrupters. Such circuit breaker structures are particularly useful in uprating existing oil circuit breakers.

2. Background Information

Oil circuit breakers commonly used in electric power transmission and distribution systems have a pair of breaker units immersed side by side in a tank of high dielectric strength oil Typically, each breaker unit has multiple sets of contacts in series The contacts are normally held closed by electrically conductive laterally extending arms of a cross-bar carried by a lift rod held in a raised position between the breaker units by an external operator. This cross-bar also connects the two interrupter circuit breaker units in series when in the raised position. When the breaker is tripped, the lift rod is driven downward by the external operator. Initial downward travel of the cross-arm with the lift rod permits spring operated mechanisms of various design within the breaker units to open the contacts thereby striking arcs. Heat generated by these arcs causes a build-up of pressure which forces oil through a grid to deionize the arcs and interrupt the flow of current. The cross-bar maintains electrical contact with the interrupter assemblies until the current has been interrupted and then separates to form a pair of isolation gaps.

There is an interest in uprating these existing oil circuit breakers to obtain increased interrupting ratings and in addition or alternatively to extend the usable life of the breaker to increase reliability and to reduce maintenance. Conventional methods of uprating oil circuit breakers require major redesigns to the interrupters, tank and operating mechanism to survive the higher explosive forces developed when interrupting and closing in to higher current faults.

Vacuum interrupters are also widely used in electric power systems. However, vacuum interrupters have an intrinsic weakness to lightning impulses, and have a tendency, when switching capacitors, to have a delayed restrike after a successful interruption. As a result, the use of vacuum interrupters has been limited to lower voltage applications. A high voltage circuit breaker in which multiple vacuum interrupters are connected in series within a tank filled with $SF_6$ is proposed in U.S. Pat. No. 3,839,612. However, this breaker requires too many vacuum interrupters to be economically feasible, and is not suitable for uprating present oil circuit breakers. Other arrangements for circuit breakers comprising multiple series connected vacuum interrupters are disclosed in U.S. Pat. Nos. 3,814,885 and 4,225,761. Again, these designs are not suitable for uprating current oil circuit breakers to forty and fifty kva ratings.

It is the primary object of the invention, therefore, to provide a means for modifying existing oil circuit breakers to increase their interrupting capability and in addition or alternatively to improve their reliability, and reduce the maintenance required to maintain them.

It is also an important object of the invention to provide such an improved circuit breaker through uprating of current oil circuit breakers.

It is a further object of the invention to provide such an improved circuit breaker which does not require redesign of and which ideally can utilize many of the components in existing oil circuit breakers.

It is an additional object of the invention to provide such an improved circuit breaker which utilizes vacuum interrupters.

It is another object of the invention to provide such an improved circuit breaker which eliminates the problem of delayed restrikes in vacuum interrupters.

It is yet another object of the invention to provide such an improved circuit breaker which comprises modular interrupter units which may be substituted for the oil breaker units in existing oil circuit breakers.

It is still another object of the invention to provide such an improved circuit breaker which applies an impact force to open the contacts of the vacuum interrupters utilizing the operator of the existing oil circuit breakers.

SUMMARY OF THE INVENTION

These and other objects are realized by the subject invention which in the broad sense comprises a circuit breaker in which a vacuum interrupter is immersed in a tank of insulating fluid between an electrical bushing and a cross-bar, such as those used in existing oil circuit breakers, in a series electrical circuit. Movement of the cross-bar operates the contacts of the vacuum interrupter, and after opening of the vacuum interrupter contacts provides an isolation gap in the series electrical circuit which fills with the insulating fluid. This isolation gap overcomes the problems of susceptibility to lightning and restrikes which have plagued prior art vacuum interrupter circuit breakers and limited their use in high voltage applications. In accordance with the invention, several vacuum interrupters can be connected in series in the oil filled tank, each with an operating mechanism operated to open the vacuum interrupter contacts before the isolation gap is open. The operating mechanism includes means to apply an impact opening force to the vacuum interrupter contacts which tend to fuse in a closed position. The operating mechanism includes a coupling which maintains electrical continuity in the series circuit through the circuit breaker until after the vacuum interrupter contacts have opened.

The vacuum interrupter units may be connected in series in a number of compact arrangements. In the simplest arrangement, using a pair of interrupters, each interrupter is connected to a bushing on either side of the lift rod which carries the electrically conductive cross-bar, with the operating mechanisms of the vacuum interrupters extending downward and being actuated directly by the cross-bar. In a modification to this arrangement, two additional vacuum interrupters can be mounted on the cross-bar with their operating mechanisms extending upward so that the operating mechanism of each of the confronting interrupters operates the operating mechanism of the other with the isolation gap appearing between the confronting interrupters when the cross-bar is lowered.

In another arrangement of four interrupter units, the two units on each side of the lift rod are offset laterally so that one vacuum interrupter extending downward from the bushing is aligned with the end terminal portion of the cross-bar and the second vacuum interrupter is mounted on an insulated support from the bushing. The terminal portions of the cross-bar are electrically conductive to connect the two interrupters on each side of the lift rod in series. The inner portion of the cross-bar connected to the lift rod is electrically insulating and the inboard vacuum interrupters are connected in series by a conductive innerconnect member at their upper ends.

Six vacuum interrupters may be arranged in accordance with the invention in groups of three on each side of the lift rod. In this arrangement, the inboard interrupters are mounted on the cross-bar and an additional vacuum interrupter is mounted on each terminal portion of the cross-bar in vertical alignment with the vacuum interrupter connected to the bushing. The series electrical circuit is through an interrupter connected to a bushing down through the aligned vacuum interrupter connected to the terminal portion of the one arm of the cross-bar, through the electrically conductive terminal portion of the cross-bar, up through the inboard vacuum interrupter, through the innerconnect member, and then in reverse direction through the group of three vacuum interrupters on the other side of the lift rod.

The invention is particularly suitable for uprating existing oil circuit breakers by replacing the oil interrupters with one or several series connected vacuum interrupters as described above. Very compact arrangements can be made which provide substantially higher ratings in the same space, with minimum replacement or modification of parts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
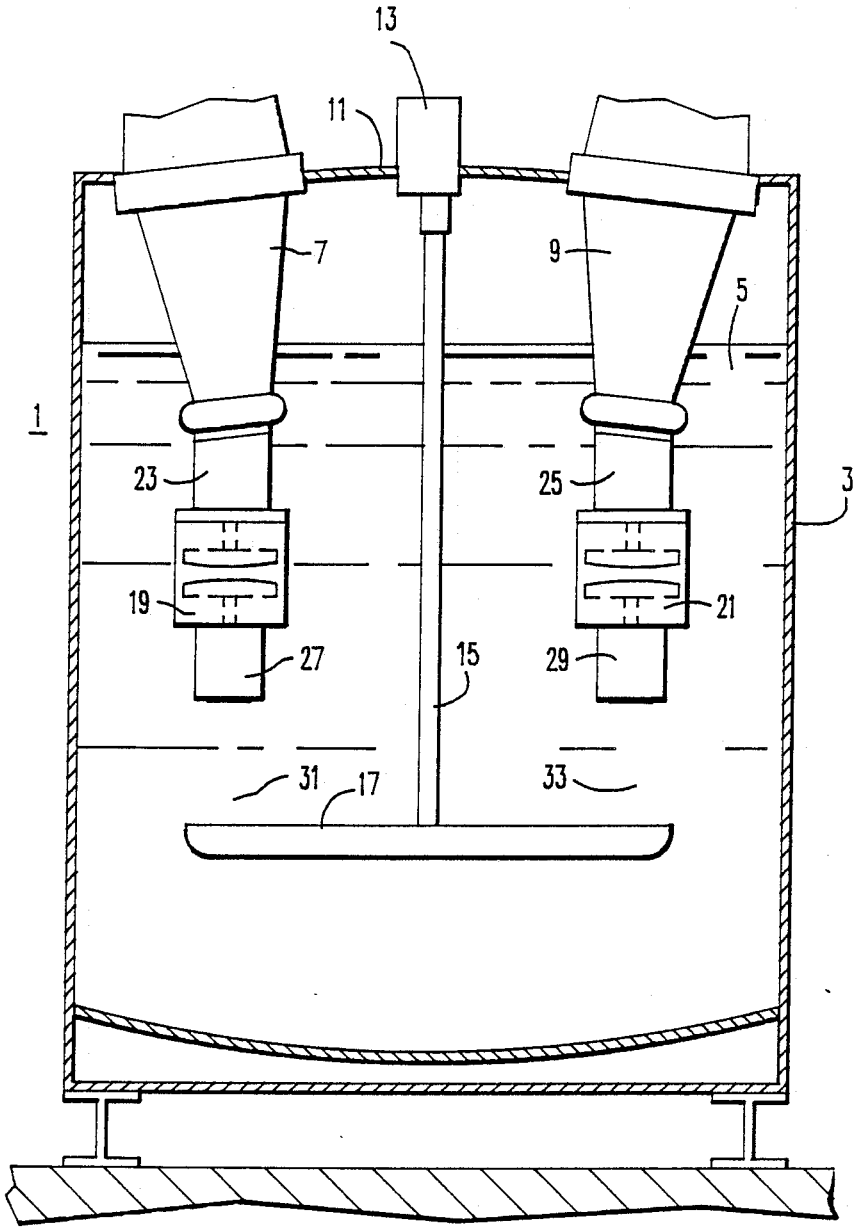
FIG. 1 is a vertical, sectional view through a circuit breaker in accordance with the invention.

Referring to FIG. 1, there is shown an oil circuit breaker 1 which has been modified in accordance with the invention. The circuit breaker 1 includes an upright cylindrical tank 3 filled with a high dielectric strength oil 5. A pair of electrical bushings 7 and 9 extend through the lid 11 of the tank and into the oil 5. An operator 13 on top of the tank raises and lowers an electrically insulating lift rod 15 which carries at its lower end an electrically conductive cross-bar 17. The conventional oil interrupters normally found in these types of circuit breakers are replaced in accordance with the invention by a pair of vacuum interrupters 19 and 21. The vacuum interrupters 19 and 21 are suspended in the oil 5 from the bushings 7 and 9 by bushing attachments 23 and 25, respectively. Each of the vacuum interrupters 19 and 21 is provided with an operating mechanism 27 and 29 respectively which extend downward toward the cross-bar 17.

As will be explained in more detail, when the cross-arm 17 is raised by the lift rod 15 through operation of the operator 13 into engagement with the operating mechanisms 27 and 29, electrical contacts within the vacuum interrupters 19 and 21 are closed, and a series electric circuit is established through the bushing 7, bushing attachment 23, vacuum interrupter 19, operating mechanism 27, electrically conductive cross-bar 17, operating mechanism 29, vacuum interrupter 21, bushing attachment 25, and bushing 9. When the circuit breaker 1 is tripped through operation of the operator 13, the lift rod 15 moves the cross-bar 17 downward to the open position shown in FIG. 1. As will also be discussed in detail, initial downward movement of the cross-bar 17 opens the electrical contacts in the vacuum interrupters 19 and 21. After these contacts have opened, the cross-bar 17 continues to move downward separating from the operating mechanisms 27 and 29 to produce isolation gaps 31 and 33 in the series electric circuit. These isolation gaps 31 and 33 which fill with the high dielectric strength oil 5, overcome the susceptibilities of the vacuum interrupters to lightning and restrikes. Typically a circuit breaker would include a unit as shown in FIG. 1 for each phase of the electrical system with the operator 13 ganged to operate all three phases of the circuit breaker simultaneously.

Figure 2:
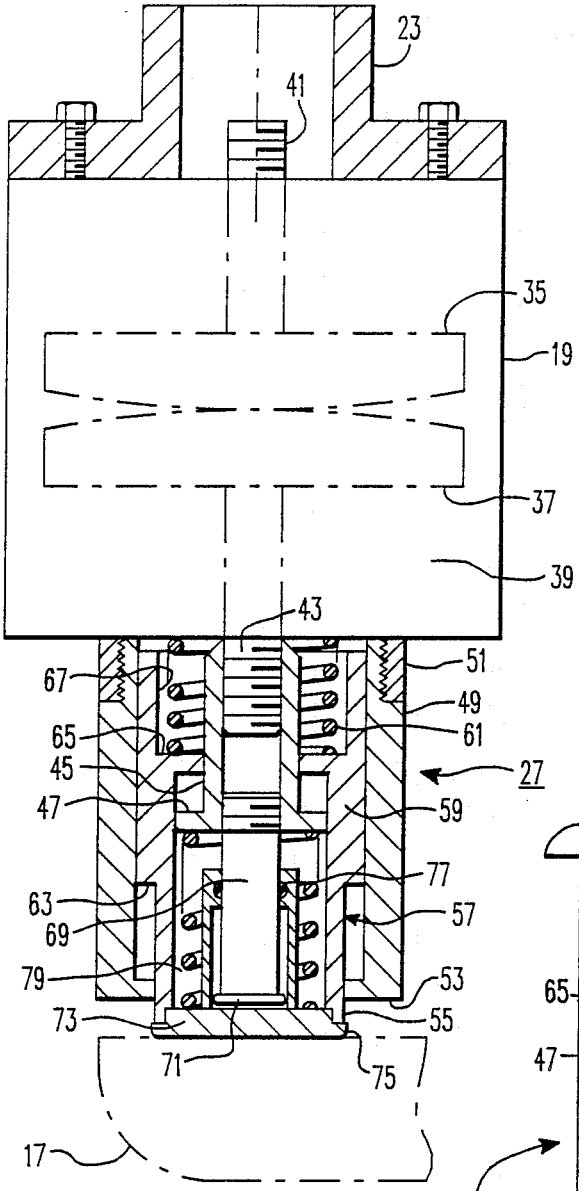
FIG. 2 is an enlarged side view of a vacuum interrupter which forms part of the circuit breaker of FIG. 1 showing the operating mechanism in the closed position in section.
Figure 3:
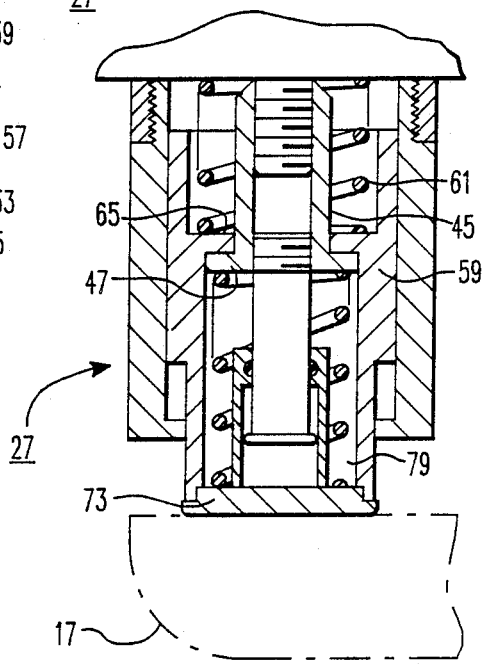
FIG. 3 is a partial sectional view similar to that of FIG. 2 showing the operating mechanism in an intermediate position.
Figure 4:
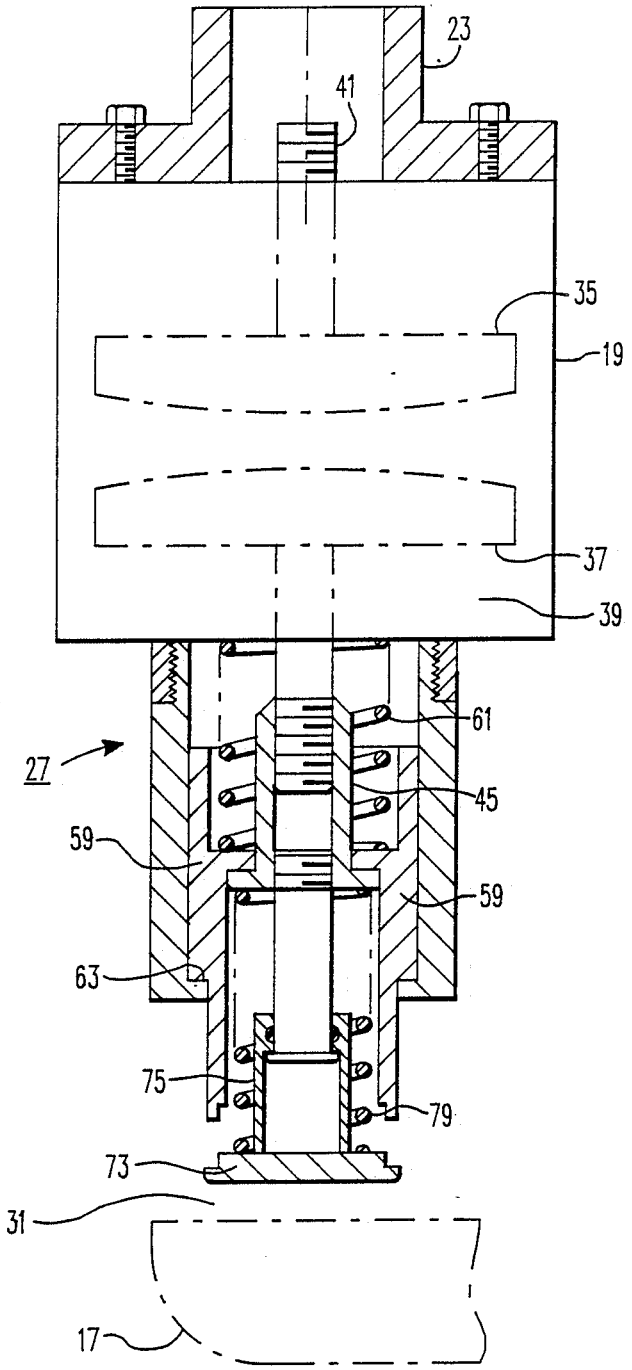
FIG. 4 is a view similar to FIG. 2 showing the operating mechanism in the open position.

FIGS. 2 through 4 illustrate in more detail the operation of the vacuum interrupters and their operating mechanisms. The vacuum interrupters 19 are conventional items well known in the field. For present purposes, it is enough to know that these interrupters include a fixed electrical contact 35, and a movable electrical contact 37. The fixed contact 35 has a stem 41 which extends upward into the bushing attachment 23 where it is connected to a bushing conductor (not shown). The movable contact 37 has a stem 43 on which is threaded a tubular extension 45 forming a free end of the contact stem. An outwardly extending radially flange 47 on the end of the stem extension 45 forms a stop.

The operating mechanism 27 for the vacuum interrupter 19 includes a cylindrical dashpot 49 threaded into an annular flange 51 on the vacuum interrupter.

The dashpot 49 has an inwardly directed radial flange 53 which defines an opening 55.

The operating mechanism 27 includes a coupling device 57 which includes a sleeve 59 and a first helical compression spring 61. The sleeve 59 slides inside the dashpot 49 and along the stem extension 45. The sleeve 59 has a reduced outer diameter at its lower end forming a shoulder 63. The sleeve 59 also has a radially, inwardly directed flange 65 which is above the flange 47 on the stem extension 45. The first spring 61 is received in a counterbore 67 in the upper end of the sleeve 59 and surrounds the stem extension 45.

A contact pin 69 is threaded into the bottom of the stem extension 45 and is provided with a radial flange 71 at its lower end. A contact button 73 has a sleeve 75 supporting electrical contact fingers 77 at its upper end which bear against the contact pin 69. A second helical compression spring 79 biases the contact button 73 downward along the contact pin 69.

The operating mechanism 27 for the vacuum interrupter 19 is shown in FIG. 2 held in the closed position by the cross-bar 17. The cross-bar 17 bears against the contact button 73 to compress the spring 79 against the stem extension 45 to close the electrical contacts 35, 37 and load the movable contact 37 with a predetermined closing force. The contact button 73 also engages the sleeve 59 of the coupling device 57 thereby raising the sleeve 59 to compress the first spring 61. With the contacts 35, 37 closed, electrical current flows through these contacts through stem 43 and extension 45 downward through the contact pin 69, outward through the contact fingers 77, and then through the sleeve 75 and the contact button 73 into the electrically conductive cross-bar 17.

When the circuit breaker 1 is tripped, the cross-bar 17 begins to move downward. As shown in FIG. 3, the spring 79 biases the contact button 73 to follow the cross arm 17. This also allows the first spring 61 to accelerate the sleeve 59 in the downward direction. The contacts 35 and 37 remain closed and the stem extension 45 remains in the full up position.

The sleeve 59 accelerates in the downward direction until the flange 65 strikes the stop 47 on the stem extension to apply an impact force to the movable contact 37. This opens the electrical contacts of the vacuum interrupter 19 and the movable contact continues to travel downward with the sleeve 59.

As shown in FIG. 4, after the contacts 37 have opened, the shoulder 63 on the sleeve 59 comes into contact with the flange 53 on the dashpot 49 secured to the bottom of the vacuum interrupter 19. This causes the sleeve 59 and the movable contact 37 to terminate movement in the downward direction. The contact button 73; however, continues to follow the cross-bar 17 in a downward direction after the electrical contacts have opened as the spring 79 continues to expand. Thus, electrical continuity between the contact pin and the cross-bar 17 is maintained. When the contact button 73 reaches the end of its downward travel as the sleeve 75 engages the flange 71 on the end of the contact pin 69, the cross-bar 17 separates from the contact button forming the isolation gap 31.

Thus, it can be seen that raising of the cross-bar 17 eliminates the isolation gap and closes the electrical contacts of the vacuum interrupter with a predetermined loading force. Initial downward movement of the cross-bar 17 allows the sleeve 59 to accelerate while the electrical contacts of the vacuum interrupter and the isolation gap remain closed. When the accelerating sleeve engages the stem extension, the electrical contacts are opened with an impact force while the isolation gap remains closed. After the electrical contacts have opened, the cross-bar 17 separates from the operating mechanism 27 and the isolation gap 31 is formed.

Figure 5:
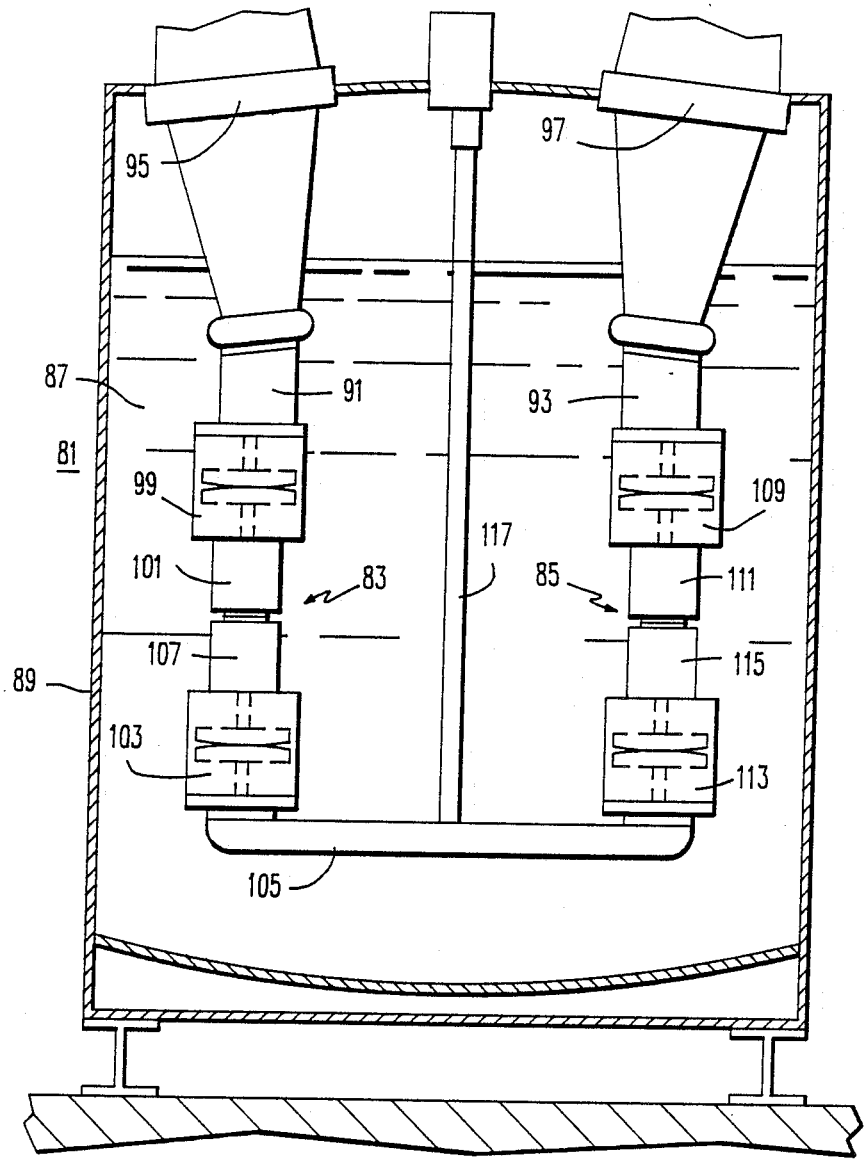
FIG. 5 is a vertical sectional view through a circuit breaker in accordance with another embodiment of the invention showing the circuit breaker in the closed position.
Figure 6:
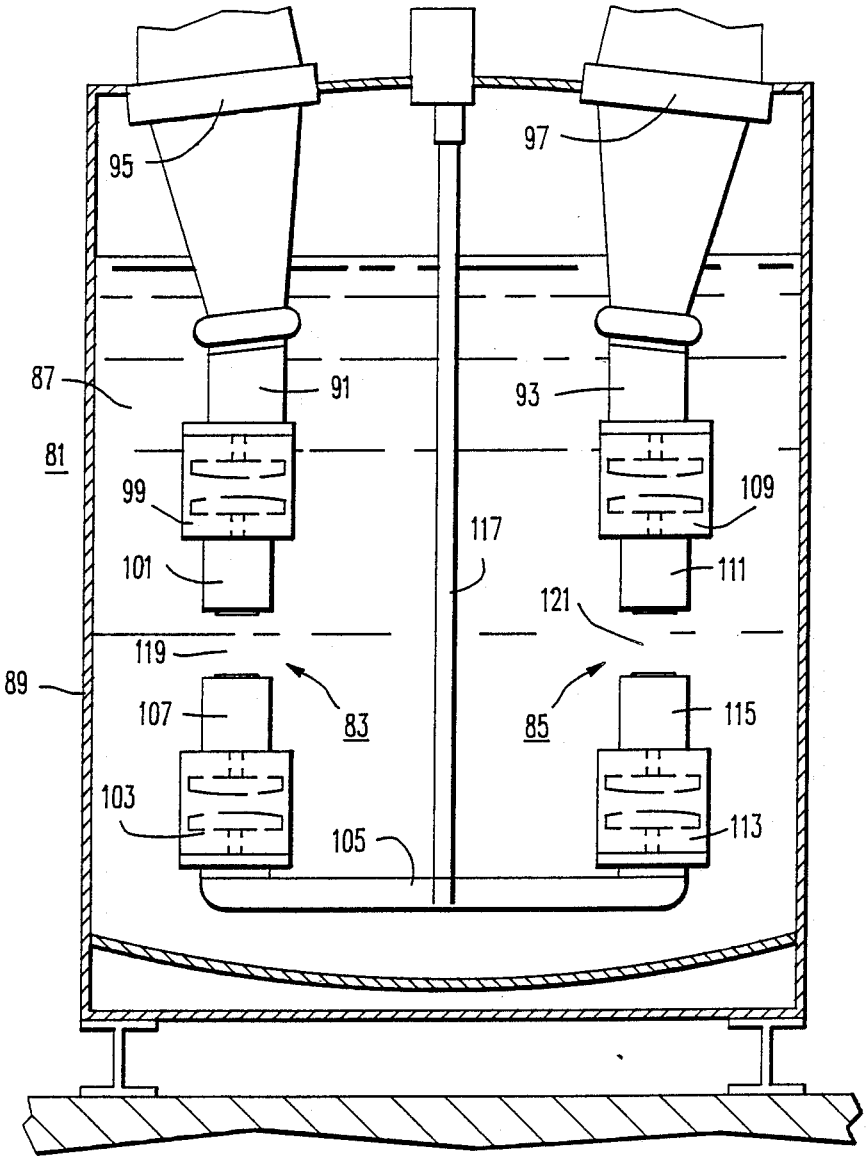
FIG. 6 is a view similar to FIG. 5 showing the circuit breaker in the open position.

FIGS. 5 and 6 illustrate a circuit breaker 81 in accordance in another embodiment of the invention in which two pairs 83 and 85 of vacuum interrupters are immersed in oil 87 in a tank 89. For illustrative purposes, the bushings 91 and 93 in this circuit breaker include current transformers 95 and 97 to show that the invention may be used with various types of bushings.

The first vacuum interrupter 99 of the pair 83 is connected to the bushing 87 with its operating mechanism 101 extending downward. The second vacuum interrupter 103 of the pair 83 is mounted on the electrically conductive cross-bar 105 with its operating mechanism 107 extending upward. Similarly, the second pair 85 of vacuum interrupters includes a first interrupter 109 connected to the bushing 93 with its operating mechanism 111 extending downward and a second vacuum interrupter 113 mounted on the cross-arm 105 with its operating mechanism 115 extending upward. With the cross-bar 105 raised to the closed position by electrically insulating lift rod 117, as shown in FIG. 5, the operating mechanisms of the upper and lower vacuum interrupters close the contacts of the other interrupter in the pair to complete the series electrical circuit through the circuit breaker. When the circuit breaker 81 is tripped and the lift rod 117 lowers the cross arm 105 carrying with it the vacuum interrupters 103 and 113, the electrical contacts of all four of the vacuum interrupters are opened and isolation gaps 119 and 121 are formed in the series electrical circuit as shown in FIG. 6.

Figure 7:
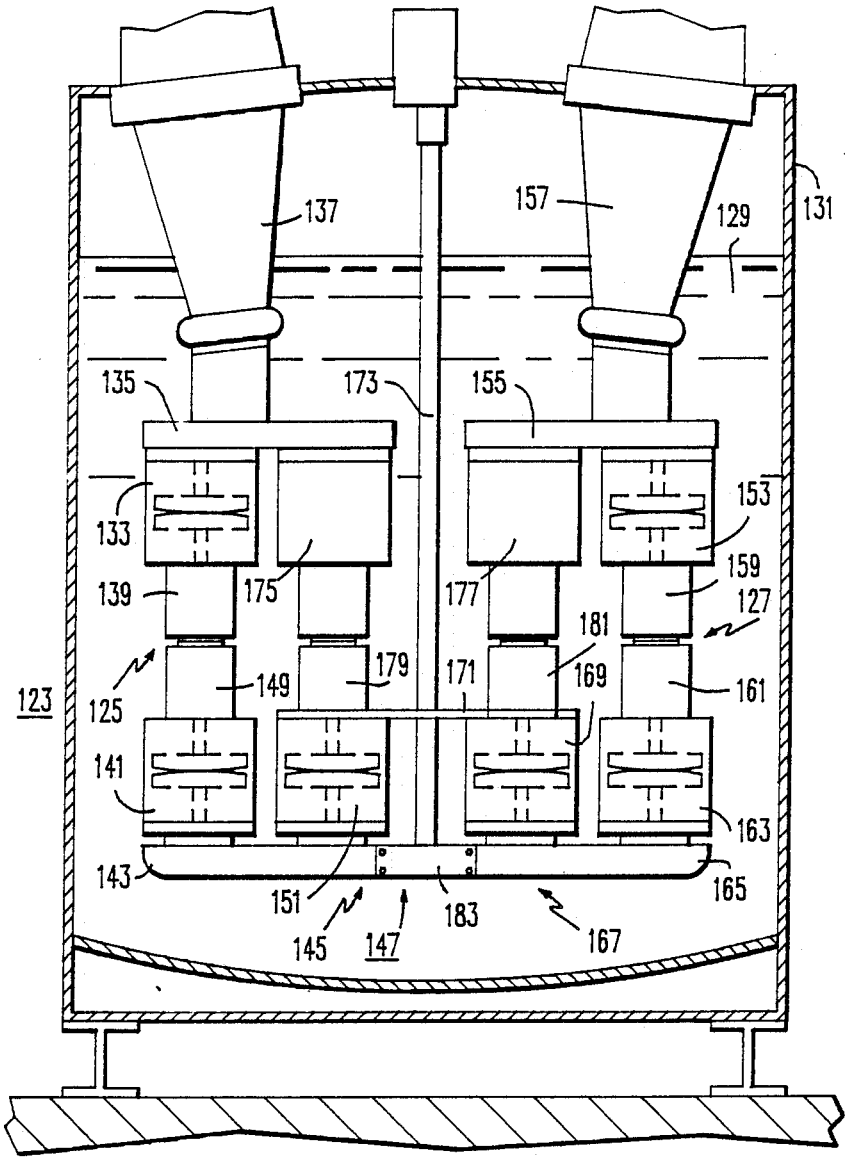
FIG. 7 is a vertical sectional view through a circuit breaker in accordance with yet another embodiment of the invention showing the circuit breaker in the closed position.
Figure 8:
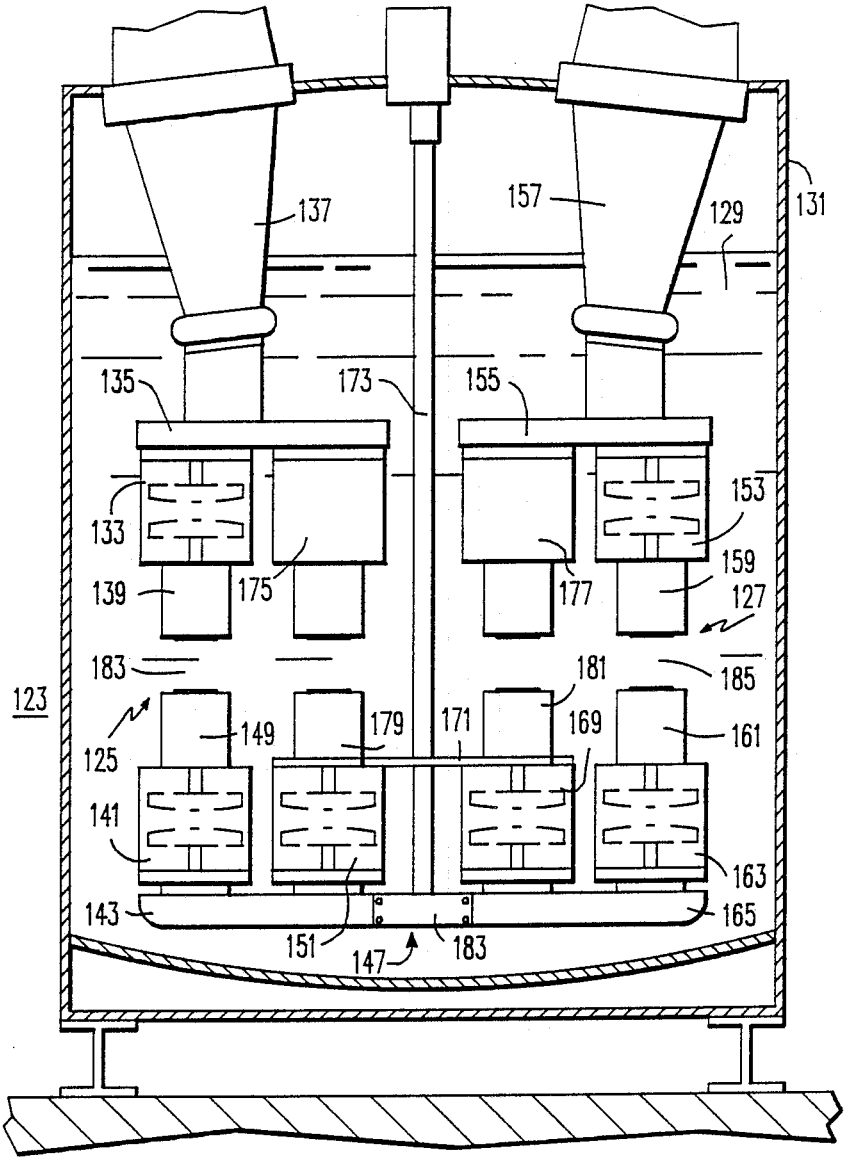
FIG. 8 is a vertical sectional view similar to FIG. 7 showing the circuit breaker in the open position.

An embodiment of the invention which includes six vacuum interrupters connected in series is illustrated in FIGS. 7 and 8. In this circuit breaker 123, first and second groups 125 and 127 respectively of three circuit breakers each are immersed in oil 129 in tank 131. The first group 125 includes a first vacuum interrupter 133 extending downward from a bushing attachment 135 connected to one bushing 137 with its operating mechanism 139 facing downward. The second vacuum interrupter 141 of the first group 125 is fixed to the electrically conductive terminal portion 143 of the left arm 145 of the cross-bar 147 with its operating mechanism 149 extending upward and in alignment with the operating mechanism 139 of the first vacuum interrupter. The third vacuum interrupter 151 is also connected to the arm 145 and is connected in series with the vacuum interrupter 141 by the electrically conductive terminal portion 143 of the arm 145.

Similarly, the second group 127 of vacuum interrupters includes vacuum interrupter 153 fixed to the bushing attachment 155 of bushing 157 with its operating mechanism 159 extending downward in alignment with the operating mechanism 161 of the second vacuum interrupter 163 mounted on the electrically conductive terminal portion 165 of the arm 167 of the cross-bar 147. The third vacuum interrupter 169 of the third group 127 is mounted on the terminal portion 165 of the arm 167 of the cross-bar 147 in series electrical contact with the second vacuum interrupter 163.

The third vacuum interrupters 151 and 169 of the first and second groups respectively are connected in series by an interconnect member 171.

With the cross-bar 147 held in the raised position by insulated lift rod 173, the electrical contacts of the each of the vacuum interrupters are closed and a series electrical circuit is established through the bushing 137, bushing attachment 135, vacuum interrupters 133 and 141, the terminal portion 143 of the cross-bar 147, vacuum interrupter 151, interconnect member 171, the vacuum interrupter 169, the terminal portion 165 of arm 167, vacuum interrupters 163 and bushing attachment 155, 153 and bushing 157. Dummy units 175 and 177 depending from the bushing attachments 135 and 155 respectively in alignment with the respective third interrupters 151 and 169 operate the operating mechanisms 179 and 181 of the vacuum interrupters 151 and 169. The inner portions 183 of the arms 145 and 167 of the cross-bar 17 are electrically insulating so that the series electric circuit extends through the vacuum interrupters 151 and 169 and the innerconnect 171.

FIG. 8 shows the circuit breaker 123 in the open position in which the lift rod 173 lowers the cross-bar 147 which carries with it the vacuum interrupters 141, 151, 169, and 163 while the interrupters 133 and 153 remain with the bushing attachments to create the isolation gaps 183 and 185 which fill with oil.

Figure 9:
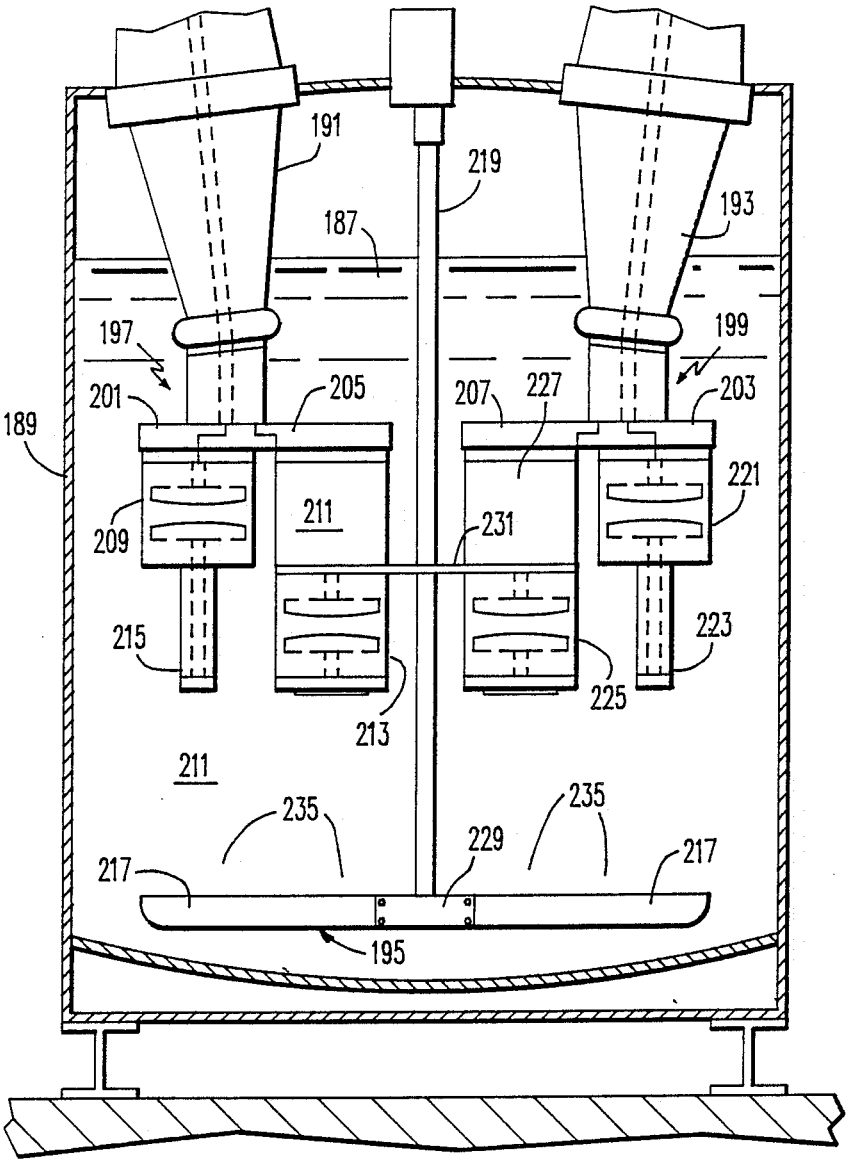
FIG. 9 is a vertical sectional view through a circuit breaker in accordance with still another embodiment of the invention showing the circuit breaker in the open position.

FIG. 9 illustrates an alternate embodiment of the invention utilizing four vacuum interrupters immersed in oil 187 in a tank 189. In this arrangement, all of the vacuum interrupters are suspended from the bushings 191 and 193, and none are carried by the cross-bar 195. Bushing attachments 197 and 199 have outer portions 201 and 203, respectively, which are electrically conductive and an inner portions 205 and 207 which are electrically insulating. Suspended from the electrically conductive portion 201 of the bushing attachment 197 is a first vacuum interrupter 209. An electrically insulating spacer of the same length of the vacuum interrupter 209 is suspended from the electrically insulating section 205 of the bushing attachment 197. A second vacuum interrupter 213 is supported by this insulating spacer 211. A terminal conducting section 217 of the cross bar 195 operates the operating mechanism of the vacuum interrupter 213 directly and the operating mechanism of the vacuum interrupter 209 through an extension 215 as it is raised and lowered by a lift rod 219.

Similarly, the other two vacuum interrupters 221 with its extension 223 and vacuum interrupter 225 supported by spacer 227 are operated by the terminal portion 217 of the other arm of the cross-bar 195. The inner portion 229 of the cross-bar 195 is electrically insulating. The vacuum interrupter 213 and 225 are connected in series by innerconnect member 231 such that with the lift rod 195 in the raised position there is a series electrical circuit extending, for instance, from the bushing 191 through the electrically conductive portion 201 of the bushing attachment 197, vacuum interrupter 209, extension 215, terminal conducting section 217 of the cross-bar, interrupter 213, innerconnect member 231, vacuum interrupter 225, terminal conducting section 217, extension 223, interrupter 221, electrically conductive portion 203 of bushing attachment 199, and the bushing 193. With the cross-bar 195, lowered four isolation gaps 235 are created, one between the cross-bar and each of the vacuum interrupters.

The present invention provides a convenient means for uprating existing oil circuit breakers with minimum modifications required. The isolation gaps produced in the series circuit through the circuit breaker by movement of the cross-bar makes it possible to use vacuum interrupters in these higher voltage applications.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A fluid insulated vacuum interrupter circuit breaker comprising:

a tank filled with a high dielectric strength oil;

a vacuum interrupter immersed in the high dielectric strength fluid in said tank and having a set of electrical contacts including a fixed contact and a movable contact movable between a closed position and an open position;

an electrical bushing;

a lift device including a lift rod and an electrically conductive cross-bar carried by said lift rod and movable by said lift rod between a raised position in which the cross-bar, vacuum interrupter, and electrical bushing form a series electrical circuit and a lowered position in which an electrical isolation gap is formed in said series electrical circuit which fills with said high dielectric strength fluid; and an operating mechanism operated to move said electrical contacts to said closed position as said cross-bar is lifted to said raised position and to move said electrical contacts to said open position before said isolation gap opens as said cross-bar is lowered to said lowered position.

2. The circuit breaker of claim 1 wherein said operating mechanism includes coupling means applying an opening impact force to move said electrical contacts to said open position as said cross-bar is moved toward said lowered position.

3. The circuit breaker of claim 2 wherein said movable contact has a stem with a free end and a stop adjacent said free end, and wherein said coupling means comprises a slide slidable along said stem, a first spring biasing said slide toward said stop, and actuating means sliding said slide along said stem away from said stop toward said electrical contacts to close said electrical contacts as said cross-bar is lifted to the raised position, and allowing said slide to accelerate along said stem and strike said stop to apply said opening impact force to said movable electrical contact as said cross-bar is lowered by the lift device, said actuating means including means maintaining said isolation gap closed until said electrical contacts open.

4. The circuit breaker of claim 3 wherein said means maintaining said isolation gap closed until said electrical contacts open includes a follower and a second spring, said second spring biasing said follower to maintain said isolation gap closed as said cross-bar moves toward said lowered position until said electrical contacts open.

5. The circuit breaker of claim 4 wherein one of said follower and stem have an elongated pin and the other a sliding contact which maintains electrical contact with said pin as said second spring biases said follower to maintain said isolation gap closed.

6. A fluid insulated vacuum interrupter circuit breaker comprising:

a tank filled with a high dielectric strength fluid;

a plurality of vacuum interrupters immersed in the high dielectric strength fluid in said tank and each having a set of electrical contacts including a fixed contact and a movable contact movable between a closed position and an open position;

a pair of electrical bushings a lift device including a lift rod and a cross-bar with electrically conductive portions carried by said lift rod and movable by said lift rod between a raised position in which said electrically conductive portions of said cross-bar, vacuum interrupters, and bushings form a series electrical circuit and a lowered position in which at least one electrical isolation gap is formed in said series electrical circuit which fills with said high dielectric strength fluid; and an operating mechanism for each vacuum interrupter operative to move the electrical contacts of the vacuum interrupter to said closed position as said cross-bar is lifted to said raised position and to move said electrical contacts to said open position before said isolation gap opens as said cross-bar is lowered to said lowered position.

7. The circuit breaker of claim 6 wherein there are two vacuum interrupters, one connected to each electrical bushing and wherein said cross-bar has two arms extending laterally outward from said lift rod, said two arms and said cross-bar having interconnected electrically conductive portions which connect said two vacuum interrupters in said series electrical circuit when said cross-bar is in said raised position.

8. The circuit breaker of claim 7 wherein said vacuum interrupters are fixed to said electrical bushings and said cross-bar moves relative to said interrupters to create two isolation gaps, one between each arm of the cross-bar and an adjacent vacuum interrupter when said cross-bar is moved toward said lowered position 9. The circuit breaker of claim 6 wherein there are two pair of vacuum interrupters and the cross-bar has two arms extending laterally outward from said lift rod with terminal portions of said arms being electrically conductive and inner portions being electrically insulating, one pair of said vacuum interrupters being arranged on one side of said lift rod for interconnection in said series electrical circuit by the electrically conductive terminal portion of one arm, and the other pair of vacuum interrupters being arranged on the other side of the lift rod for interconnection in said series electrical circuit by the electrically conductive terminal portion of the other arm, and an interconnect member connecting said two pair of vacuum interrupters in said series electrical circuit.

10. The circuit breaker of claim 9 wherein one vacuum interrupter in each pair is fixed to one of said electrical bushings and the other vacuum interrupter in the pair is fixed to said cross-bar with the other vacuum interrupter in the two pair of vacuum interrupters interconnected by said interconnect member, and wherein isolation gaps are formed between said one vacuum interrupter in each pair and the electrically conductive terminal portion of the cross-bar arm.

11. The circuit breaker of claim 10 wherein said one vacuum interrupter in each pair fixed to said electrical bushing is provided with an extension substantially equal in length to the other vacuum interrupter in the pair, such that with the cross-bar in the raised position to close said electrical contacts in said vacuum interrupters and the isolation gaps, said one vacuum interrupter in each pair remains vertically displaced above the other vacuum interrupter and hence further insulated from said other vacuum interrupter by said high dielectric strength fluid.

12. The circuit breaker of claim 11 including an insulating spacer extending downward from each bushing parallel to said one vacuum interrupter and aligned with the other vacuum interrupter, said spacer operating said operating mechanism to close and open said electrical contacts of said other vacuum interrupter as said cross-bar is raised and lowered.

13. The circuit breaker of claim 6 wherein there are two groups of three vacuum interrupters each and the cross-bar has two arms extending laterally outward from said lift rod with terminal portions of said arm being electrically conductive and inner portions being electrically insulating, one group of said vacuum interrupters being arranged on each side of said lift rod, with first and second vacuum interrupters in each group in vertical alignment between an associated bushing and an adjacent arm of the cross-bar and a third vacuum interrupter in the group laterally spaced from the second vacuum interrupter in the group and connected in said series electrical circuit therewith by the electrically conductive terminal portion of the cross-bar, and including an interconnect member connecting said third vacuum interrupters in the two groups, and therefore said two groups of vacuum interrupters, in said series electrical circuit.

14. The circuit breaker of claim 13 wherein the first vacuum interrupter in each group is fixed to the associated bushing, the second and third vacuum interrupters are fixed to the adjacent arm of the cross-bar, the operating mechanism of the first vacuum interrupter extends downward, the operating mechanism of the second vacuum interrupter extends upward and is aligned with the operating mechanism of the first vacuum interrupter, such that the operating mechanisms of the first and second vacuum interrupters each operate the operating mechanism of the other as said cross-bar is raised and lowered and the isolation gaps are formed between the first and second vacuum interrupters.

15. The circuit breaker of claim 6 wherein there are two pair of vacuum interrupters, one pair of vacuum interrupters being arranged on each side of said lift rod with one vacuum interrupter in each pair extending downward form one bushing and the other mounted on and extending upward from the electrically conductive cross-bar and in alignment with said one vacuum interrupter, said isolation gaps being formed between said vacuum interrupts in each pair when said cross-bar is moved to the lowered position.

16. The circuit breaker of claim 15 wherein the operating mechanism of said one circuit breaker in each pair extends downward and the operating mechanism of the other vacuum interrupter in the pair extends upward such that the operating mechanisms of the vacuum interrupters in each pair are operated by each other.

* * * * *